US009769567B2

(12) United States Patent
Scarlett

(10) Patent No.: US 9,769,567 B2
(45) Date of Patent: Sep. 19, 2017

(54) AUDIO SYSTEM AND METHOD

(71) Applicant: NXP B.V., Eindhoven (NL)

(72) Inventor: Shawn Scarlett, Nijmegen (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 14/852,430

(22) Filed: Sep. 11, 2015

(65) Prior Publication Data

US 2016/0080864 A1 Mar. 17, 2016

(30) Foreign Application Priority Data

Sep. 15, 2014 (EP) ..... 14184729

(51) Int. Cl.

*H04R 3/02* (2006.01)
*G10L 21/0208* (2013.01)
*H04R 3/00* (2006.01)

(52) U.S. Cl.

CPC ..... *H04R 3/02* (2013.01); *G10L 21/0208* (2013.01); *H04R 3/005* (2013.01); *H04R 2400/01* (2013.01); *H04R 2410/07* (2013.01); *H04R 2460/01* (2013.01); *H04R 2499/11* (2013.01)

(58) Field of Classification Search

CPC . H04R 3/02; H04R 3/005; H04R 5/04; H04R 29/005; G10K 11/1784

USPC ..... 341/110; 348/207.99; 370/286; 379/390.02, 392.01; 381/61, 66, 71.1, 381/71.11, 71.6, 71.7, 72, 94.1, 94.2, 381/71.5, 317, 318; 704/226, 233, 500; 84/604; 327/291; 455/550.1; 714/776; 181/199

See application file for complete search history.

(56) References Cited

U.S. PATENT DOCUMENTS 4,061,875 A * 12/1977 Freifeld ..... H04M 1/19 381/72
5,732,143 A * 3/1998 Andrea ..... G10K 11/178 381/71.13
6,804,203 B1 * 10/2004 Benyassine ..... H04M 9/082 370/286

(Continued)

OTHER PUBLICATIONS

"Group Report: Smart and Connected Microphones and Speakers"; The 17th Annual Interacitve Audio Conference—Project Bar-B-Q 2012; 7 pages; retrieved from the Internet http://www.projectbarbq.com/bbq12/Project_Bar-B-Q_2012_report_section_3.pdf Aug. 6, 2015.

(Continued)

*Primary Examiner* — Gerald Gauthier

(57) ABSTRACT

An audio processing system and method are described. A microphone is arranged to generate a microphone output signal responsive to an acoustic input. A speaker is arranged to generate an acoustic output responsive to a speaker input signal and to generate a speaker output signal responsive to the acoustic input. A wind noise detector is arranged to receive and process the microphone output signal and/or the speaker output signal to detect wind noise. A signal processor is arranged to receive the microphone output signal and is configured to process the speaker output signal when wind noise has been detected. The microphone output signal is modified using a result of processing the speaker output signal to reduce the amount of wind noise in a processed audio signal output by the signal processor.

18 Claims, 2 Drawing Sheets

(56) References Cited

U.S. PATENT DOCUMENTS 6,842,516 B1 * 1/2005 Armbruster ..... H04M 9/082 379/388.01
7,174,023 B2 * 2/2007 Ozawa ..... H04R 3/005 381/94.1
7,895,036 B2 * 2/2011 Hetherington ..... G10L 21/0208 381/94.8
8,058,543 B2 * 11/2011 Han ..... H04R 3/04 84/604
8,370,724 B2 * 2/2013 Chiba ..... G10L 19/005 714/776
8,509,451 B2 * 8/2013 Hayakawa ..... G10L 21/0208 381/104
8,600,072 B2 * 12/2013 Park ..... H04R 3/007 381/94.1
9,197,975 B2 * 11/2015 Buck ..... H04R 3/005
9,247,346 B2 * 1/2016 Kuo ..... H04R 3/002
9,318,094 B2 * 4/2016 Hendrix ..... G10K 11/1784
9,357,307 B2 * 5/2016 Taenzer ..... H04R 3/005
2005/0136848 A1 6/2005 Murray
2005/0226431 A1 * 10/2005 Mao ..... G10L 21/0208 381/61
2005/0238183 A1 10/2005 Ozawa
2006/0233407 A1 * 10/2006 Steinbuss ..... H04R 25/502 381/317
2007/0263847 A1 * 11/2007 Konchitsky ..... G10L 21/0208 379/392.01
2008/0192945 A1 * 8/2008 Mcconnell ..... H04M 9/082 381/66
2009/0002498 A1 * 1/2009 Oku ..... H04N 5/23293 348/207.99
2009/0290735 A1 * 11/2009 Schanz ..... H04R 25/604 381/318
2010/0056198 A1 * 3/2010 Tachibana ..... H04M 9/082 455/550.1
2010/0082339 A1 * 4/2010 Konchitsky ..... G10L 21/0208 704/226
2011/0004470 A1 * 1/2011 Konchitsky ..... G10L 21/0208 704/226
2011/0181452 A1 * 7/2011 Raifel ..... H04R 3/02 341/110
2011/0273213 A1 * 11/2011 Rama ..... H04W 52/029 327/291
2011/0282660 A1 * 11/2011 Hetherington ..... G10L 21/0208 704/226
2012/0308025 A1 * 12/2012 Hendrix ..... G10K 11/1784 381/71.11
2012/0310639 A1 * 12/2012 Konchitsky ..... G10L 21/0208 704/226
2012/0310640 A1 * 12/2012 Kwatra ..... G10K 11/1784 704/233
2013/0044887 A1 2/2013 Dong et al.
2013/0048413 A1 * 2/2013 Patzer ..... H04M 1/04 181/199
2013/0066638 A1 * 3/2013 Mason ..... G10L 19/00 704/500
2013/0165178 A1 * 6/2013 Lee ..... H04M 1/00 455/550.1
2013/0177163 A1 * 7/2013 Hsiao ..... H04R 3/00 381/71.1
2013/0259250 A1 * 10/2013 Nicholson ..... G10K 11/1782 381/71.6
2014/0006019 A1 * 1/2014 Paajanen ..... G10L 21/0208 704/233
2014/0046659 A1 * 2/2014 Burton ..... G06Q 10/10 704/226
2014/0161271 A1 * 6/2014 Teranishi ..... H04R 5/04 381/71.7
2015/0117660 A1 * 4/2015 Fletcher ..... G10K 11/178 381/72
2015/0358730 A1 * 12/2015 Kirsch ..... H04R 3/002 381/71.1
2015/0371659 A1 * 12/2015 Gao ..... G10L 21/0208 704/226
2016/0080864 A1 * 3/2016 Scarlett ..... H04R 3/005 381/94.1

OTHER PUBLICATIONS

Industructables; retrieved from the Internet http://www.instructables.com/id/turn-ANY-speaker-into-a-microphone-in-just-2-easy-/ (Aug. 11, 2015).
European Patent Aplication 14184894.5, filed Sep. 16, 2014, not yet published.
Extended European Search Report for application 14184729.3 (Mar. 10, 2015).

* cited by examiner

AUDIO SYSTEM AND METHOD

CROSS-REFERENCE TO RELATED APPLICATIONS

This application claims the priority under 35 U.S.C. §119 of European patent application no. 14184729.3, filed Sep. 15, 2014 the contents of which are incorporated by reference herein.

The present invention relates generally to audio systems and in particular to audio systems and audio processing methods for ameliorating the effect of background acoustic noise on audio applications.

There are a large number of communications devices which can provide telephony over a communication network whether wired, wireless or a combination thereof. Mobile or cellular phones are specific telephony devices, but other communications devices having more general purposes, such as desk top and lap top computers, tablets, PDAs, can also provide telephony either using a telephone network or over a computer network, for example using a voice-over-IP protocol (sometimes referred to VoIP). Generally all that is required is that the communications device includes a microphone to convert a caller's voice into an electronic signal for processing and subsequent transmission and a speaker to convert an electronic signal corresponding to the callee's received voice into an acoustic output.

The quality of the telephony can depend on a number of factors including for example, the speed of the communications network, the data or signal processing capabilities of the terminal devices and the amount of electrical noise present in either terminal device or on the communications network.

However, another factor can also be the environment in which the communication device is being used. For example, if there is a significant level of background acoustic noise, such as wind noise, then this can make it hard to hear a speaker's voice.

Another consequence of a significant level of background noise, such as wind noise, is that a sensitive microphone can pick up the wind noise and the wind noise may mask or reduce the intelligibility of the speaker's voice. In some circumstances, the wind noise can be so significant as to saturate the microphone and any associated amplifier thereby rendering the device useless or even inoperable. If wind noise is a rare event, then this can be tolerable. If the wind noise is persistent, then this can be avoided or reduced by moving to a different location away from the wind noise. However, this may not be possible in circumstances where the wind noise is present in all of the immediate vicinity.

Wind noise can also be a problem when using other systems having audio functions other than telephony when trying to capture and/or record a desired audio signal when significant background acoustic noise is present.

Apparatus and methods which can help to reduce the impact of background acoustic noise on audio systems would therefore be beneficial.

A first aspect of the invention provides an audio processing system, comprising: a microphone arranged to generate a microphone output signal responsive to an acoustic input; a speaker arranged to generate an acoustic output responsive to a speaker input signal and to generate a speaker output signal responsive to the acoustic input; a wind noise detector arranged to receive and process the microphone output signal and/or the speaker output signal to detect wind noise; and a signal processor arranged to receive the microphone output signal and configured to process the speaker output signal when wind noise has been detected and to modify the microphone output signal using a result of processing the speaker output signal to reduce the amount of wind noise in a processed audio signal output by the signal processor.

When wind noise is detected in the microphone or speaker output signal, then a signal from the speaker acting as a microphone can be processed and used to modify the microphone signal to reduce the wind noise present in an audio signal. Hence, the speaker can be re-purposed to also provide an audio signal less affected by wind noise and hence providing extra information which can be used to improve an audio signal by reducing the wind noise present.

The audio processing system may further comprise a signal routing device in communication with the speaker and the signal processor. The signal routing device may be controllable to route the speaker output signal to the signal processor. The signal routing device may be a switch and in particular an electronically operable switch. The signal routing device may be a demultiplexer which can separate input and output signals of the speaker.

The signal routing device may be controllable by the wind noise detector to route the speaker output signal to the signal processor when wind noise is detected by the wind noise detector. Hence, the speaker output signal is only provided for processing when wind noise has been detected.

The signal routing device may be controllable to route the speaker output signal to the signal processor whenever there is no speaker input signal. Hence, the speaker output signal is processed at all times that the speaker does not need to be available to provide an acoustic output.

The signal processor may be configured to modify the microphone output signal by replacing the microphone output signal with the processed speaker output signal. If the microphone output signal has no or little useful component of the audio signal of interest, then the processed audio signal output by the processor may be based entirely on processing of the speaker output signal.

The signal processor may be configured to modify the microphone output signal by combining the microphone output signal with the processed speaker output signal. If the microphone output signal has some useful component of the audio signal of interest, then the processed audio signal output by the processor may be based on a combination of the microphone output signal and the processed speaker output signal.

The signal processor may be configured to process the speaker output signal to reduce the amount of wind noise in the processed speaker output signal. The speaker output signal may be filtered to reduce the amount of wind noise.

The signal processor may be configured to process the microphone output signal to reduce the amount of wind noise in the microphone output signal using one or more results of processing the speaker output signal. The microphone output signal may be filtered to reduce the amount of wind noise.

The system may comprise a plurality of microphones. The system may include two or three microphones. Each microphone may be arranged to generate a respective microphone output signal responsive to the acoustic input. The wind noise detector may be arranged to receive and process the microphone output signals to detect wind noise. The signal processor may be arranged to receive the microphone output signals and to modify the microphone output signals using the result of processing the speaker output signal to reduce the amount of wind noise in the processed audio signal output by the signal processor. Multiple microphones may improve the reliability of detection of wind noise or different types of wind noise.

The system may further comprises a plurality of speakers. The system may include two or three speakers. Each speaker may be arranged to generate an acoustic output responsive to a respective speaker input signal and to generate a respective speaker output signal responsive to the acoustic input. The signal processor may be configured to process the speaker output signals when wind noise has been detected and to modify the microphone output signal using a result of processing the speaker output signals to reduce the amount of wind noise in the processed audio signal output by the signal processor. Multiple speakers may improve the amount and/or quality of information relating to the target audio signal available to improve the quality of the audio signal output by the signal processor.

A second aspect of the invention provides a portable electronic device comprising: an audio sub-system; and the audio processing system of the first aspect of the invention and wherein the processed audio signal output by the signal processor is supplied to the audio sub-system.

The audio sub-system may be a media sub-system and the processed audio signal may be supplied to the media sub-system for recording or storage.

The audio subsystem may be a telephony sub-system and the processed audio signal may be supplied to the telephony subsystem for transmission.

The portable electronic device may be a mobile telephone and the mobile telephone may further include an earpiece speaker in communication with the telephony sub-system and the speaker may be a loud speaker ancillary to the earpiece speaker.

A third aspect of the invention provides an audio processing method for reducing the amount of wind noise in an audio signal, comprising: monitoring a microphone output signal and/or a speaker output signal; processing the microphone output signal and/or the speaker output signal to detect the presence of wind noise in the microphone output signal and/or speaker output signal; and if wind noise is not detected then passing an audio signal including the microphone output signal to an audio sub-system and if wind noise is detected, then processing the speaker output signal to modify the microphone output signal using a result of processing the speaker output signal to reduce the amount of wind noise in the audio signal passed to the audio sub-system.

Preferred features of the first and second aspects of the invention may also be preferred counterpart features of the method aspect of the invention.

An embodiment of the invention will now be described in detail by way of example only, and with reference to the accompanying drawings, in which:

BRIEF DESCRIPTION OF THE DRAWINGS

Similar items in the different Figures share like reference numerals unless indicated otherwise or required by the context.

An embodiment of the invention will now be described within the context of a cellular phone or mobile phone. However, it will be appreciated that the invention is not limited either to a specific mobile phone construction nor to mobile phones. Rather, the invention can be, or can be part of, any type of electronic device which has some audio functionality and which includes a microphone for receiving an acoustic input and also a loud speaker. The loudspeaker may be additional or an ancillary to any output provided to output a callee's voice signal in normal use, for example an earpiece speaker. The invention is particularly useful in electronic devices having a telephony function and hence may be used in a wide range of terminal communication devices ranging from telephony specific, such as smart phones, features phones and other generations of mobile phones, through to general purpose computing devices which also have a telephony function, such as a computer. The invention is particularly beneficial for communications devices which are portable and/or which are frequently used in environments in which wind is common.

DETAILED DESCRIPTION

Figure 1:
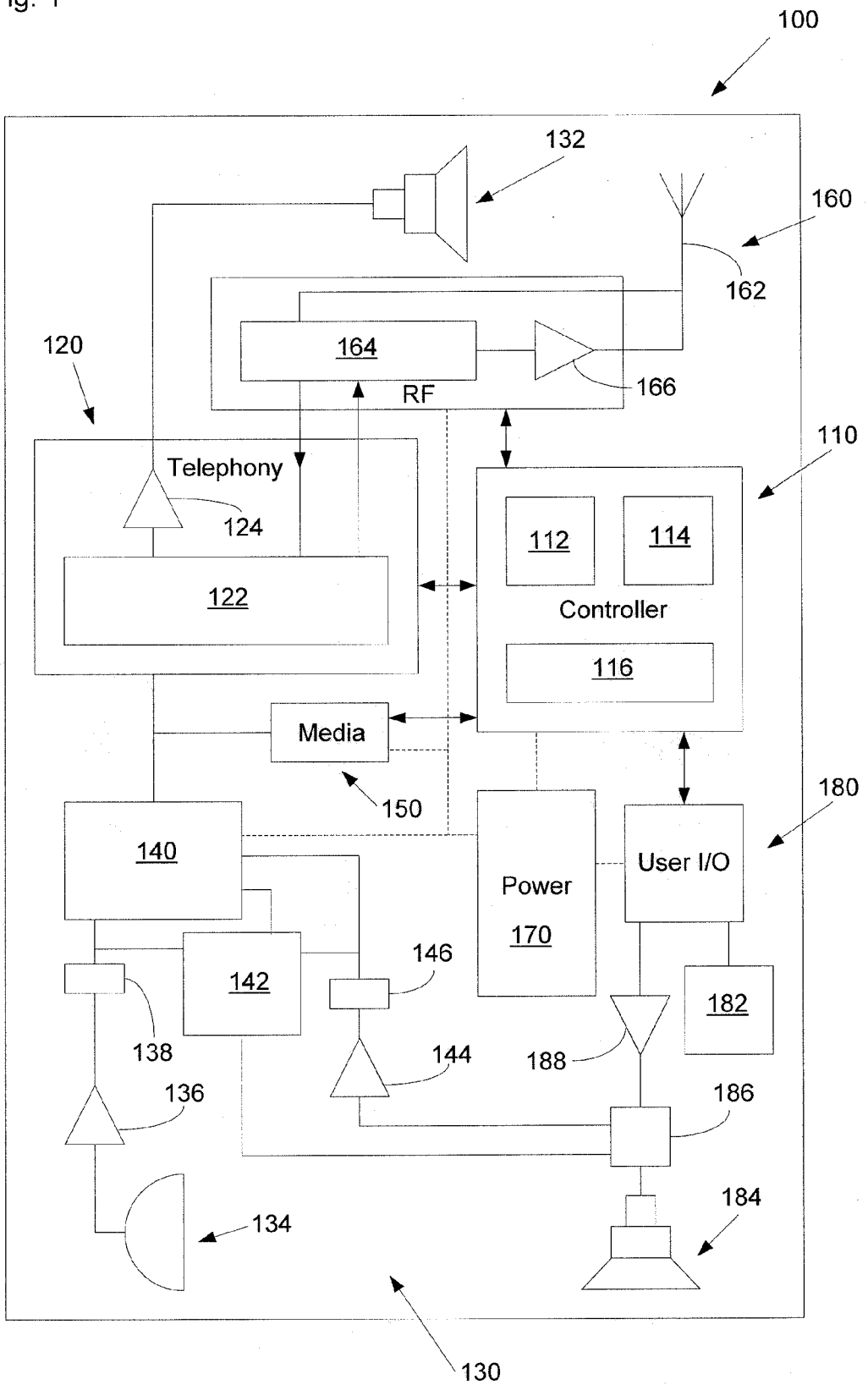
FIG. 1 shows a schematic block diagram of a portable electronic device according to an aspect of the invention and including an audio processing system also according to an aspect of the invention.

FIG. 1 shows a schematic block diagram of an electronic device 100 according to the invention and in the form of a mobile phone, being merely one example of a portable communication device. FIG. 1 is schematic and illustrates the major functional items typically present in a mobile phone. Other common features are omitted from FIG. 1 so as not to obscure the nature of the present invention, but are well known by a person of ordinary skill in the art. Further, the blocks shown in FIG. 1 are largely arranged by functionality and it will be appreciated that in practice the functions provided by the various blocks may be physically, arranged in other ways and/or distributed amongst other blocks or components, and may be implemented by different arrangements of specific electronic circuits, components or devices.

The mobile phone 100 includes a controller subsystem 110 which provides high level control of the overall operation of the mobile phone and also interacts with the other subsystems to issue and receive command signals and data signals. For example the controller subsystem may include a microcontroller, 112, a digital signal processor 114 and memory 116, which may include RAM, ROM, EEPROM and other forms of electronic storage. The mobile phone 100 also includes a first audio subsystem in the form of a telephony subsystem 120, which handles much of the audio signal processing used to make a telephone call, a second audio subsystem in the form of a media subsystem 150, an RF subsystem 160, a power subsystem 170, and a user input/output subsystem 180. The mobile phone also includes an audio processing system or circuitry 130 according to the invention and which operates to help reduce the effect of wind noise in acoustic signals.

The RF subsystem includes an antenna 162 for wirelessly sending and receiving RF electromagnetic signals which encode transmitted and received voice signals, an RF transceiver 164, which may include modulator, synthesizer and receiver parts, and a power amplifier 166 which amplifies the power of the signal to drive the antenna 162. The modulator of the RF transceiver can receive an outgoing voice signal from an RF interface part of the telephony circuit 120 for encoding prior to transmission and the receiver part of the RF transceiver can decode a received RF signal to generate an incoming voice signal which is passed to the RF interface of the telephony subsystem 120.

The power subsystem 170 includes a power supply, handles power management and supplies electrical power to all the other parts or subsystems of the mobile phone as schematically illustrated by various dashed lines in FIG. 1.

The user input/output subsystem 180 provides an interface between various user input and output devices, which may include, for example, one or more of a touch screen 182, a keyboard (not shown), buttons and or switches (also not shown). The user I/O system 180 also includes a loud speaker 184 with an input connected via a signal routing device 186 to an audio amplifier 188. In normal use, the loud speaker 184 provides various types of audio output which is broadcast so that a user can generally hear it, such as audio media playback, alerts or other audible signals, or an incoming call voice if the mobile phone is being used in a speakerphone mode.

The media subsystem 150 provides a further audio subsystem and handles the processing of various media items, such as sound files, image files and/or video files. Images may be displayed on the screen 182 and media items having audio content may be played back using loud speaker 184. Media subsystem 150 may include one or more cameras and/or video cameras (not shown) for capturing images. Media subsystem may also provide various media play back functionalities, such as a video player and a voice recording and playback functionality.

The mobile phone also includes an earpiece speaker 132 and one or more microphones, represented by microphone symbol 134 which acts as transducers. The earpiece speaker 132 converts an electrical signal output from the telephony subsystem 120 into an output acoustic signal and the microphone or microphones 134 convert acoustic signal into one or more electrical signals as an input to the audio processing subsystem 130. The electrical signal from the microphone 134 can includes various components including a desired acoustic signal, such as a voice signal component corresponding to the user's voice during telephony or speech or music acoustic components when recording video, and also various unwanted acoustic background components which can be considered acoustic noise. The acoustic noise can vary both with time or position or both.

The electrical signal output by the microphone therefore represents all the acoustic signals detected by the microphone which will include the user voice and also any significant environmental or back ground acoustic noise. The output from the microphone is supplied to an amplifier 136 whose output is passed through an analogue to digital converter 138 whose output digital signal is passed as a first input to a first signal processing block 140. The output of the first signal processing block 140 is the processed audio signal and is then passed to one or more of the audio subsystems. For example, the processed audio signal can be passed to a second signal processing block 122, of the telephony subsystem 120, which may be digital or analogue or a combination thereof. The second signal processing block 122 includes logic, or is otherwise configured or arranged, to implement any conventional processing of audio signals including voice content for telephony, such as one or more codecs to encode the voice signal for transmission or decode received voice signals for output. The encoded voice signal for transmission is then passed to the RF subsystem 160 by a first output of the second signal processing block acting as part of an RF interface to the modulator of the RF transceiver 164 for transmission.

A second output of the second processing block 122 is supplied via an audio amplifier 124 to supply an amplified output signal to drive the earpiece speaker 122 (and also optionally to an earpiece connector or socket if provided). An incoming call signal is received by the antenna 162, demodulated by the receiver of the RF transceiver 164, passed by the RF subsystem 160 to the RF interface of the telephony processing block 122 and any conventional signal processing of the incoming call signal is carried out, such as decoding the incoming call signal. The electrical signal output to the amplifier 124 therefore represents the incoming audio signal from another user's phone and which may include voice and any background components depending on whether the other user is speaking or not.

The audio processing system 130 also includes a third processing block 142 which includes logic, or is otherwise configure or arranged, to detect a wind noise. The third processing block 142 receives as a first input the digitised microphone output signal. A first output of the third processing block 142 can supply a control signal to the loud speaker signal routing device 186. A second output of the third, processing block 142 can supply a wind noise detection signal and/or wind noise data signals as inputs to the first processing block 140. An output of the signal routing device 186 is supplied to an amplifier 144 whose output is passed via an analogue to digital converter 146 which provides a digitised loud speaker output signal as an input to the first processing block 140. In some embodiments, in which the loudspeaker output signal is additionally or alternatively used to detect the presence of wind noise, the digitised loud speaker output signal can also be supplied as an input to the third processing block 142.

Figure 2:
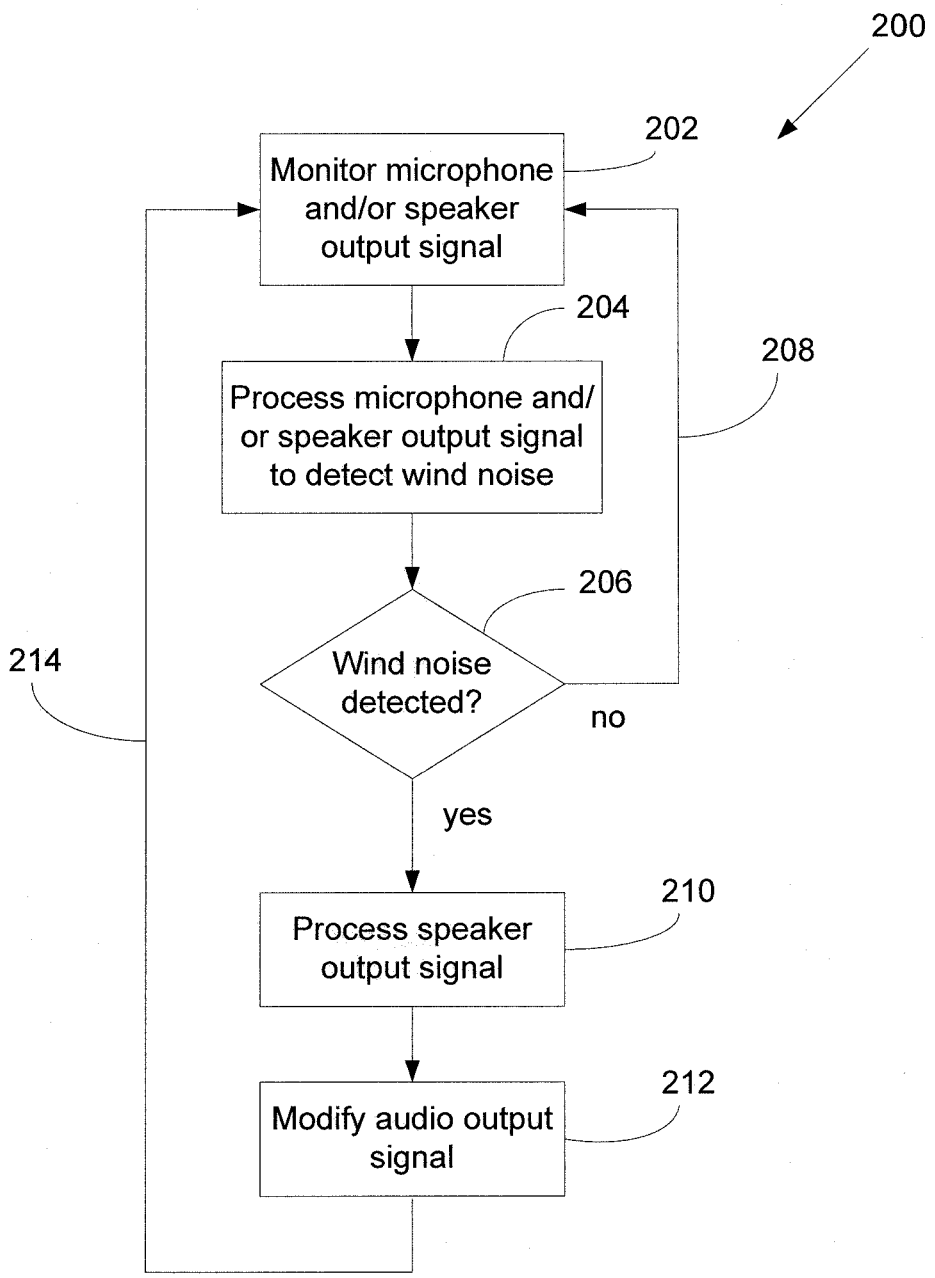
FIG. 2 shows a flow chart illustrating an audio processing method also according to an aspect of the invention.

Operation of the audio processing system 130 of the invention will now be described with reference additionally to FIG. 2 which shows a process flow chart illustrating an audio signal processing method 200 also according to the invention. At step 202 the digitised microphone output signal is passed to the wind noise detection processing block which continuously or periodically monitors the microphone signal. The wind noise detection processing block processes the microphone output signal at 204 to detect the presence of a wind noise component in the microphone output signal. In other embodiments, the loud speaker output signal can additionally, or alternatively, be passed to the wind noise detection block 142 at step 202 and be processed at 204 to detect the presence of a wind noise component in the loudspeaker output signal.

A variety of techniques or approaches can be used to detect the presence of wind noise in the microphone signal and/or loudspeaker signal. The signal output by the loudspeaker can also be considered a 'microphone' signal as the loud speaker can act as a microphone even though not primarily a microphone. Techniques, algorithms and processes for detecting wind noise in one or more microphone signals are generally known by a person of ordinary skill in the art. For example, a one microphone approach can compare the time-averaged, low frequency noise spectrum with the spectral levels and shape which are expected for wind. This can give a fairly stable estimate of the wind spectrum level and provides a technique better suited to constant rather than intermittent wind conditions. A dual microphone technique involves calculating the correlation between the two microphone signals. When there is no wind, then the microphone signals are highly correlated, as the audio signal is similar at both microphones. When significant wind noise is present, then the correlation is poor as the turbulence that causes wind noise depends on the location of each microphone. This dual-microphone approach is better at detecting sudden gusts of wind compared to the single microphone approach.

Irrespective of the wind noise detection technique used at step 204, at step 206 it is determined whether wind noise has been detected by the wind noise detecting block 136. If not, then processing returns to step 208 and the microphone output signal and/or loudspeaker output signal continues to be monitored. Hence, if no wind noise is detected, the microphone output signal is simply output as the processed audio signal by the first processing block 140 to the telephony subsystem 120 for encoding before transmission.

Alternatively, if wind noise is detected in the microphone and/or loudspeaker signal at step 206, then processing proceeds to step 210. The wind noise detection block 142 outputs a signal to the first processing block 140 which indicates that wind noise has been detected. That signal may also include wind noise data relating to one or more properties of the wind noise that has been detected. The wind noise detection block 142 may also output a signal to the speaker signal routing device 186 causing the signal output by the loud speaker 184 when operating as a microphone to be routed to amplifier 144 and analogue to digital converter 146 and supplied as a digitised speaker output signal as input to the first processing block 130. In other embodiments, the output of the loudspeaker may simply be passed to the amplifier 144 at some or all times when the loudspeaker is not being used for playback. In one embodiment, the speaker signal routing device 186 may simply be an electronically controllable switch which routes the signal output by the loud speaker 184 to the first processing block 140 and isolates the loud speaker from the power transistors of audio amplifier 188.

In other embodiments, the signal routing device 186 may be a demultiplexer which separates the output signals from the loudspeaker from the input signals input to the loudspeaker. In some embodiments, the signals to and from the loud speaker may pass over a common wire or wires and in other embodiments, a different wire or wires may be used for input signals to drive the loud speaker, and output signals when the loud speaker is acting as a microphone.

Wind noise can cause very large displacements for the microphone 134 itself and as a result can easily saturate the microphone and/or its amplifier 136, resulting in the loss of the signal. The loud speaker 184 is larger than the microphone 134 and has a moving surface much larger than the microphones. Also, the speaker may have a much larger port opening then the microphone. Hence, the loud speakers 184 can be used in reverse as a microphone and can be referred to as "speaker-as-microphone". Because the speaker 184 is physically larger than the microphone 134, and/or its opening port is larger, it is less sensitive to localised disturbances and its lower sensitivity also prevents saturation. As a result the signal received from the speaker-as-microphone 184 during wind noise can have better performance in terms of capturing the desired audio signal than the signal from the microphone 134.

Irrespective of how the speaker-as-microphone output signal is routed by routing device 186 from the speaker to the first processing block 140, at step 210, the speaker output signal is processed by the first processing block 140. Processing of the speaker output signal may involve one or more processes used to improve the desired audio component of the signal which it is intended to capture. The results of the processing carried out at step 210 may be used to replace or augmenting the microphone output signal with the desired audio signal component, for example the voice component, of the speaker output signal. For example, at step 210, the speaker output signal may be processed to reduce the wind noise component and/or to enhance the voice component. This may include filtering to remove or reduce the wind noise component. Additionally, or alternatively, the processing may involve amplifying the voice component relative to the wind noise component. The wind noise data detection signal received from the wind noise detection circuit may be used to initiate processing of the speaker output signal and the wind noise data received from the wind noise detection circuit may be used to control, adjust or otherwise adapt processing of the speaker output signal, for example by setting parameters of a filtering and/or amplification process.

At step 212 the audio signal is modified using one or more of the results of processing the speaker output signal. Modifying the audio signal may involve replacing the speaker output signal entirely, enhancing the microphone output signal or combining the microphone output signal and the speaker output signal. Again, the wind noise detection signal received from the wind noise detection circuit may be used to initiate processing of the microphone output signal and the wind noise data received from the wind noise detection circuit may be used to control, adjust or otherwise adapt processing of the microphone output signal to modify the audio signal to be output, for example by setting parameters of a filtering and/or amplification process applied to the microphone output signal or parameters determining how to combine the microphone output signal and loudspeaker output signal. The wind noise detection signal and/or the wind noise data may also be used by processing block 140 to determine whether and how to modify the audio output signal, either by replacement or combination, and also how the microphone output signal and speaker output signal are combined in order to improve the desired audio component by removing wind noise.

After the audio signal has been modified at step 212, the processed audio signal may be passed to the second processing block 122 for encoding and is then passed to the RF transceiver 164 for transmission.

In other embodiments, the processed audio signal may be passed to other audio subsystems. For example, during video recording, the processed audio signal may be passed to the media subsystem 150 for storage together with captured video image data as the video soundtrack. For example, during recording a voice memo, the processed audio signal may be passed to the media subsystem 150 for storage as a sound file which can subsequently be played back over speaker 184.

Hence, the audio processing circuitry of the invention can help to reduce the impact of background wind noise on a number of audio functionalities.

As noted above, the system can use a standard speaker designed for playback of audio signals, typically with a large diaphragm and with a large opening in the enclosure. Both of these improve the speaker's performance as a microphone in the presence of wind noise.

The voice microphone 134 can be a standard microphone as commonly used in mobile phones a similar, but is more susceptible to wind noise and saturation. As noted above, in some embodiments multiple microphones can be used, for example to 2 or 3, and which can improve wind noise detection and reduction. However none of the voice microphones 134 are used in a speaker-as-microphone mode, to provide the benefits that the speaker-as-microphone 184 does.

The signal routing device 186, which in some embodiments can simply be a switch, can be used to isolate the loud speaker 184, as the output signal from the speaker when operating as a speaker-as-microphone would otherwise be disturbed by the amplified output of audio amplifier 188, and so the power transistors of the audio amplifier may be disconnected.

The speaker signal routing device 186 could be activated to route the speaker output signal to the first processing block 140 and/or the wind noise detection processing block 142 whenever there is no signal being output from audio amplifier 188, when the communication device is in a silent mode of operation, or only when wind noise is detected as being present. At a minimum the signal routing device 186 may be controlled by the wind noise detection block 142. In other embodiments, signal routing device can be controlled to route the speaker output signal to the first processing block 140 and/or the wind noise detection block 142 whenever the audio amplifier 188 is off. As noted above, in some embodiments, the signal routing device 186 does not have the form or a switch, for example if the output signal from the speaker is separated, or separable, from the input signal to the speaker 184. However, a switch can be used in simpler embodiments.

The first processing block 140 can be located in any available digital signal processor (DSP) in the system, for example the DSP 114 in the main application processor 110 or as a separate special purpose DSP. As explained above, the first processing block is configured to modify the audio signal it outputs by combining or replacing the audio signal from the microphone or microphones 134 with the audio signal from the speaker so that the processed audio signal it outputs is improved by reducing the amount of wind noise.

The wind noise detection processing block 142 may control the signal, routing device 186 and may also control the first processing block 140 so that it processes the incoming audio signals when wind noise is present. The wind noise detection block 142 can also be located in any available DSP in the system, for example the DSP 114 of the main application processor 110 or as a separate special purpose DSP.

Although particularly appropriate for mobile or cell phones, the invention can be applied to other types, of communication terminal expected to work in all common environments. Wind noise is a significant problem for microphones when used outside. Other wind noise reduction techniques have relied on mechanical methods of blocking wind from reaching the microphone and/or signal processing techniques that try to remove the interfering signal generated by the wind or try to reconstruct portions of the signal lost due to the interference.

Wind noise has many causes, some of which are related to air turbulence passing directly over the microphone port or microphone membrane. This effect is made worse by a small microphone port as the microphone becomes sensitive to smaller, i.e., more localized, turbulence.

As explained above, wind noise can cause very large displacements for the microphone and as a result can easily saturate the microphone, resulting in the loss of the desired signal. Attempting to address this by extending the dynamic range of the microphone can still result in wind noise overpower the desired audio signal. Hence, the invention takes a different approach to lowering the impact of the wind, such that the desired audio signal can still be captured.

The processing method can be can be implemented entirely in hardware, or in software or as a combination. The hardware components may be general purpose components which are configured to provide the desired functionality by software or may be specific purpose hardware components.

Various modifications and changes to the described embodiments will be apparent to a person of ordinary skill in the art in light of the preceding discussion of the invention.

The invention claimed is:

1. An audio processing system, comprising:

a microphone arranged to generate a microphone output signal responsive to an acoustic input;

a speaker arranged to generate an acoustic output responsive to a speaker input signal and to generate a speaker output signal responsive to the acoustic input, the speaker having a larger diaphragm than the microphone;

a wind noise detector arranged to receive and process the microphone output signal to detect wind noise; and a signal processor arranged to receive the microphone output signal and configured to process the speaker output signal when wind noise has been detected and to modify the microphone output signal using a result of processing the speaker output signal to reduce the amount of wind noise in a processed audio signal output by the signal processor.

2. The audio processing system of claim 1, and further comprising a signal routing device in communication with the speaker and the signal processor and controllable to route the speaker output signal to the signal processor.

3. The audio processing system of claim 2, wherein the signal routing device is controllable by the wind noise detector to route the speaker output signal to the signal processor when wind noise is detected by the wind noise detector.

4. The audio processing system of claim 2, wherein the signal routing device is controllable to route the speaker output signal to the signal processor whenever there is no speaker input signal.

5. The audio processing system of claim 1, wherein the signal processor is configured to modify the microphone output signal by replacing the microphone output signal with the processed speaker output signal.

6. The audio processing system of claim 1, wherein the signal processor is configured to modify the microphone output signal by combining the microphone output signal with the processed speaker output signal.

7. The audio processing system of claim 5, wherein the signal processor is configured to process the speaker output signal to reduce the amount of wind noise in the processed speaker output signal.

8. The audio processing system of claim 1, wherein the system comprises a plurality of microphones and wherein each microphone is arranged to generate a respective microphone output signal responsive to the acoustic input, the wind noise detector is arranged to receive and process the microphone output signals to detect wind noise and the signal processor is arranged to receive the microphone output signals and to modify the microphone output signals using the result of processing the speaker output signal to reduce the amount of wind noise in the processed audio signal output by the signal processor.

9. The audio processing system of claim 1, wherein the system further comprises a plurality of speakers each arranged to generate an acoustic output responsive to a respective speaker input signal and to generate a respective speaker output signal responsive to the acoustic input and wherein the signal processor is configured to process the speaker output signals when wind noise has been detected and to modify the microphone output signal using a result of processing the speaker output signals to reduce the amount of wind noise in the processed audio signal output by the signal processor.

10. The audio processing system of claim 1, wherein the wind noise detector is arranged to receive and process the speaker output signal to detect wind noise.

11. A portable electronic device comprising:

an audio sub-system; and an audio processing system, the audio processing system including:

a microphone arranged to generate a microphone output signal responsive to an acoustic input received at the microphone, a speaker arranged to generate an acoustic output responsive to a speaker input signal and to generate a speaker output signal responsive to an acoustic input received at the speaker, a wind noise detector arranged to receive and process the microphone output signal to detect wind noise, and a signal processor arranged to receive the microphone output signal and configured to process the speaker output signal when wind noise has been detected and to modify the microphone output signal using a result of processing the speaker output signal to reduce the amount of wind noise in a processed audio signal output by the signal processor, wherein the processed audio signal output by the signal processor is supplied to the audio sub-system; and wherein the speaker has a larger diaphragm than the microphone.

12. A portable electronic device as claimed in claim 11, wherein the audio sub-system is a media sub-system and the processed audio signal is supplied to the media sub-system for recording.

13. A portable electronic device as claimed in claim 11, wherein the audio subsystem is a telephony sub-system and the processed audio signal is supplied to the telephony subsystem for transmission.

14. The portable electronic device of claim 13, wherein the portable electronic device is a mobile telephone and wherein the mobile telephone further includes an earpiece speaker in communication with the telephony subsystem and wherein the speaker is a loud speaker ancillary to the earpiece speaker.

15. The portable electronic device of claim 11, wherein the wind noise detector is arranged to receive and process the speaker output signal to detect wind noise.

16. The portable electronic device of claim 11, and further comprising a signal routing device in communication with the speaker and the signal processor and controllable to route the speaker output signal to the signal processor.

17. The portable electronic device of claim 16, wherein the signal routing device is controllable by the wind noise detector to route the speaker output signal to the signal processor when wind noise is detected by the wind noise detector.

18. A portable electronic device comprising:

an audio sub-system; and an audio processing system, the audio processing system including:

a microphone arranged to generate a microphone output signal responsive to an acoustic input received at the microphone, a speaker arranged to generate an acoustic output responsive to a speaker input signal and to generate a speaker output signal responsive to an acoustic input received at the speaker, a wind noise detector arranged to receive and process the microphone output signal to detect wind noise, and a signal processor arranged to receive the microphone output signal and configured to process the speaker output signal when wind noise has been detected and to modify the microphone output signal using a result of processing the speaker output signal to reduce the amount of wind noise in a processed audio signal output by the signal processor, wherein the processed audio signal output by the signal processor is supplied to the audio sub-system; and wherein the audio sub-system is a media sub-system and the processed audio signal is supplied to the media sub-system for recording.

* * * * *